US010625904B2

(12) United States Patent
Serras et al.

(10) Patent No.: US 10,625,904 B2
(45) Date of Patent: Apr. 21, 2020

(54) BEVERAGE BOTTLE, A METHOD OF MANUFACTURING A BEVERAGE BOTTLE AND A METHOD OF DESIGNING AN ILLUSTRATION

(71) Applicants: COMPAGNIE GERVAIS DANONE, Paris (FR); GRAHAM PACKAGING COMPANY, L.P., York, PA (US)

(72) Inventors: Ines Dias Rosa Nunes Serras, Barcelona (ES); Armel Archeny, Briord (FR); Gilles Perez, Vourles (FR)

(73) Assignees: COMPAGNIE GERVAIS DANONE, Paris (FR); GRAHAM PACKAGING COMPANY L.P., York, PA (US)

( * ) Notice: Subject to any disclaimer, the term of this patent is extended or adjusted under 35 U.S.C. 154(b) by 644 days.

(21) Appl. No.: 14/889,379

(22) PCT Filed: May 6, 2014

(86) PCT No.: PCT/EP2014/059169
§ 371 (c)(1),
(2) Date: Nov. 5, 2015

(87) PCT Pub. No.: WO2014/180812
PCT Pub. Date: Nov. 13, 2014

(65) Prior Publication Data

US 2016/0083137 A1 Mar. 24, 2016

Related U.S. Application Data

(60) Provisional application No. 61/819,730, filed on May 6, 2013.

(51) Int. Cl.
*B65D 23/08* (2006.01)
*B65D 1/02* (2006.01)
(Continued)

(52) U.S. Cl.
CPC ..... *B65D 23/0878* (2013.01); *B65B 3/04* (2013.01); *B65B 21/245* (2013.01); *B65B 53/00* (2013.01);
(Continued)

(58) Field of Classification Search
CPC ..... B65D 23/0878; B65D 23/0842; B65D 23/0871; B65D 1/0223; B65D 81/365;
(Continued)

(56) References Cited

U.S. PATENT DOCUMENTS 5,791,505 A * 8/1998 Gilliland ..... B65D 51/24 215/228
5,809,674 A * 9/1998 Key ..... B65D 23/0885 40/306
(Continued)

FOREIGN PATENT DOCUMENTS

GB 2 402 379 A 12/2004
JP H09-77037 A 3/1997

OTHER PUBLICATIONS

International Search Report, dated Jun. 25, 2014, from corresponding PCT Application.

*Primary Examiner* — Steven A. Reynolds
(74) *Attorney, Agent, or Firm* — Young & Thompson

(57) ABSTRACT

A beverage bottle, a method of manufacturing a beverage bottle and a method of designing an illustration on a beverage bottle, the beverage bottle including a container (12) and a shrink-wrap (14), the container (12) having an annular sidewall (16), a bottom (18) and an opening (20) opposed to the bottom (18), the sidewall (16) extending along a longitudinal central axis (X-X) between the bottom (18) and the opening (20), the sidewall (16) being provided with a first outside constriction (22) and a second outside constriction (24) and with a first embossment (26) located between the first and second outside constrictions (22, 24), the sidewall
(Continued)

(16) being covered with the shrink-wrap (14), the shrink-wrap (14) being depicted with an illustration having a first simulate relief (R1), the first simulate relief (R1) and the first embossment (26) being in correspondence.

28 Claims, 5 Drawing Sheets

(51) Int. Cl.

| | |
|---|---|
| ***B65D 81/36*** | (2006.01) |
| ***B65B 3/04*** | (2006.01) |
| ***B65B 21/24*** | (2006.01) |
| ***B65B 53/00*** | (2006.01) |
| ***B65D 75/00*** | (2006.01) |

(52) U.S. Cl.
CPC ..... *B65D 1/0223* (2013.01); *B65D 75/002* (2013.01); *B65D 81/365* (2013.01)

(58) Field of Classification Search
CPC ..... B65D 75/002; B65D 71/08; B65D 1/40; B65D 1/44; B65B 21/245; B65B 21/24
USPC ..... 206/457, 497, 459.5; 215/382, 384; 40/310; 220/669
See application file for complete search history.

(56) References Cited

U.S. PATENT DOCUMENTS 6,601,703 B1 * 8/2003 Jones ..... B65D 1/0223 206/457
2005/0044760 A1 * 3/2005 Bailey ..... G09F 23/00 40/310

* cited by examiner

BEVERAGE BOTTLE, A METHOD OF MANUFACTURING A BEVERAGE BOTTLE AND A METHOD OF DESIGNING AN ILLUSTRATION

FIELD OF THE DISCLOSURE

The invention relates to beverage bottles comprising a container and a shrink-wrap.

BACKGROUND OF THE DISCLOSURE

In particular, the invention is related to beverage bottles comprising a container and a shrink-wrap, said container having a sidewall, a bottom and an opening opposed to said bottom, said sidewall extending along a longitudinal central axis between said bottom and said opening.

Generally, the beverage bottles comprising a container and a shrink-wrap are shrunk only onto a part of the sidewall. Especially when the sidewall of the container is provided with a first outside constriction and a second outside constriction and with a first embossment located between the first and second outside constrictions, the shrink-wrap is provided on the sidewall without covering the first outside constriction, the second outside constriction and the first embossment. This kind of beverage bottle is generally dedicated to children, the beverage bottle representing a character like an animal for instance since it can be a second of packaging (the child considering the beverage bottle as a toy to be collected). Usually the embossment represents in relief the face of the animal. The manufacturing of such beverage bottles generally obtained by molding process is expensive because each time the face of the character changes new molds are needed. Besides, the shrinking step is easy as long as the shrink-wrap does not cover the embossment.

It is however also known beverage bottles comprising a container having such an embossment which is covered by the shrink wrap. However, in that case the embossment is dissymmetric and it leads to a complication of the manufacture since the container needs to be oriented prior the shrinking step such that the embossment is well oriented with regard to the shrink wrap film depicted with the illustration. For example, orientation would be required to align the illustration of a body and/or clothes, with an embossed head. More precisely, if we take again the example of an animal depicted on the beverage bottle, one should easily understand that the illustration depicted on the shrink wrap film needs to be aligned with the embossment during the shrinking step, otherwise, the visual effect will be lacking aesthetic or worse be ugly, especially when a character is depicted on the shrink wrap (one ear being for instance in place of nose of the face). This result leads generally to the disposal of the beverage bottle.

SUMMARY OF THE DISCLOSURE

In order to reduce the cost of manufacturing beverage bottles provided with a shrink and to improve their visual effect, it is provided a beverage bottle comprising a container and a shrink-wrap, said container having a annular sidewall, a bottom and an opening opposed to said bottom, said sidewall extending along a longitudinal central axis between said bottom and said opening, said sidewall being provided with a first outside constriction and a second outside constriction and with a first embossment located between the first and second outside constrictions, the sidewall being covered with the shrink-wrap, said shrink-wrap being depicted with an illustration having a first simulate relief, said first simulate relief and said first embossment being in correspondence.

Actually, the whole container is annular all along its height and is axisymmetric around the central axis. The illustration can be a character, for example an animal, a robot, a human being such as a boy, a girl, a man or a woman, or another fantasy character having a head. The illustration preferably comprises a head part and a body and/or clothes part. The body is understood as any part different from a head, and can show members such as legs, arms, tail, wings, etc. . . . The body is typically radially aligned with the head according to regular anatomy of the character. The clothes can be any clothes, including accessories, such as shirt, jacket, sweater, pants, necklace, tie, etc. . . . The clothes are typically radially aligned with the regular anatomy and/or form of the character, a tie being for example radially aligned with the centre of a head.

By simulate relief it is meant a part of the illustration in 2D (2-dimensions), which is depicted on the shrink-wrap (also in 2D), comprises a relief (form in 3D or 3-dimensions) and the 3-dimensions of said relief is improved by the embossment (which is in 3D). However, the shape of the 3-dimensions of the embossment is simple and does not correspond to the exact representation of the relief. Thus, the relief is simulated on the shrink-wrap and the 3D is improved by corresponding the embossment and the simulate relief. A person looking at the beverage bottle will thus have the feeling that the beverage bottle is provided with a shape which correspond to the relief depicted on the illustration, whereas it is only a visual effect.

The illustration depicted, for example a head, has at least one protruding point (relief), preferably the extremity of a nose, mouth, ear, beak, trump, chin, forehead, cheeks. This at least cone point is positioned vertically on the part of the embossment having the largest diameter.

The external shape of the beverage bottle comprises successively along the longitudinal central axis, view from the external of the bottle, at least a concave shape, a convex shape and a concave shape, since at least externally, the first and second outside constrictions are concave view from the external of the bottle, whereas the embossment is convex view from the external of the bottle.

Besides, with such a beverage bottle according to the invention, since the first simulate relief and the first embossment are in correspondence, the visual effect of the first simulate relief of the illustration is improved. Actually, the combination of the first embossment and the first simulate relief makes the character represented on the shrink wrap covering the sidewall of the container appearing visually with more 3D effect than it has in reality, especially for the first simulate relief. Resides, the beverage bottle according to the invention leads to an increase of the capacity of the production lines, since it is less complex, more beverage bottles can be produced. This is due to the fact that there is no need to stop the line because the beverage bottle needs to be thrown due to an unlucky non-correspondence between the shape of the sidewall of the container and the character depicted on the shrink wrap.

The illustration is obtained on the shrink wrap by known methods (printing, etc.).

In various embodiments or the beverage bottle according to the invention, one and/or the other of the following features may be incorporated in this cover alone or in mutual combination:

a character provided with a head which is at least partially in correspondence with the first embossment;

the illustration is provided with prominent points (relief) of illustrated matter; the relief can be preferably the extremity of a nose, mouth, ear, beak, trump, chin, forehead, cheeks;

the sidewall is provided with a third outside constriction, said sidewall being provided with a second embossment located between the second and third outside constrictions, the illustration of the shrink-wrap being depicted with a second simulate relief, said second simulate relief and said second embossment being in correspondence; as explained for the beverage bottle provided with only one first embossment, the 3D visual effect is improved. When the beverage bottle is provided with a first one and a second one, since the second simulate relief and the second embossment are also in correspondence, the visual effect of the second simulate relief of the illustration is also improved. Actually, the combination of the second embossment and the second simulate relief makes the character represented on the shrink wrap covering the sidewall of the container appearing visually with more 3D effect than it has in reality, especially for the first simulate relief and for the second simulate relief;

the height of the container along the longitudinal central axis is comprised between 70 mm and 125 mm along the longitudinal central axis;

the first, second and optionally third outside constrictions are superimposed along the longitudinal central axis and are spaced apart from each other by a height which is comprised between 5% and 50% of the container height along the longitudinal central axis; this height is for instance of at least 2 mm; besides, the first constriction can be located at a height of about 50% of the container height from the bottom of the container;

each of the first, second and optionally third outside constrictions each forms an annular groove all the way round the sidewall; since the container is cylindrical (axisymmetric) the embossments and the constrictions are also axisymmetric about the longitudinal central axis;

the shrink-wrap surrounds all the way round the sidewall in extending between the opening and the bottom, the shrink-wrap being spaced along the longitudinal central axis from the opening by a opening height having a value comprised between 1% and 20% of the container height, preferably between 1% and 10% of the container height, preferably of 5% of the container height (for instance of a minimum of 9 mm when the container height is of about 100 mm) and from the bottom by a bottom height having a value comprised between 0.5% and 20% of the container height (H1), preferably between 1% and 10%, preferably of 5% of the container height (for instance of a minimum of 2 mm when the container height is of about 100 mm); the shrink-wrap surrounding all the way round the sidewall is like a full sleeve provided onto the sidewall of the container. Due to this full sleeve, the barrier to oxygen is improved; this property is particularly for dairy beverages.

the container is further provided with a flange located between the opening and the first outside constriction, and wherein the shrink-wrap surrounds all the way round the sidewall in extending between the flange and the bottom, the shrink-wrap being spaced along the longitudinal central axis from the flange by a flange height having a value comprised between 0.5% and 10% of the container height, preferably of 3% of the container height (for instance a minimum of 3 mm when the container height is of about 100 mm) and from the bottom by a bottom height having a value comprised between 0.5% and 20% of the container height, preferably between 1% and 10% of the container height, preferably of 2% of the container height (for instance a minimum of 2 mm when the container height is of about 100 mm);

the sidewall is annular all along the longitudinal central axis between the bottom and the opening; any section transversal to the longitudinal central axis (which is also the central axis) is thus circular even for the constrictions and for the embossment; the fact that the sidewall is annular all along the central axis (i.e. the outer shape of the sidewall—the constrictions and embossments included—is axisymmetric) leads to an improvement of the beverage bottle and of its manufacture; more precisely, it leads to a better distribution of material during the manufacture of the container, it gives a better resistance to compression and there is no longer a need to have means adapted to guide angularly the container when shrunk in order to obtain a correspondence of the character and the shape of the sidewall of the container. Beside, complex forms as provided on known beverage bottles which are asymmetric induce weakness points than are no longer present on the beverage bottle of the invention especially since the beverage bottle of the invention (container and shrink wrap) is axisymmetric; the quality of the beverage bottle and especially the container is improved. Besides, there is a better adaptation in case an Extrusion Blow Molding (EBM) is used for manufacturing the container;

the sidewall has an internal diameter and an internal maximum diameter which is comprised between 10% and 75% of the container height, preferably between 25% and 50% of the container height, the sidewall having a diameter which varies along the longitudinal central axis and having a minimum diameter which is comprised between 50% and 95% of the container maximum diameter, preferably between 70% and 80% of the container maximum diameter and wherein the first and the second outside constrictions each has an internal diameter comprised between 100% of the minimum diameter and 95% of the maximum diameter, preferably 80% of the maximum diameter and wherein first embossment has an internal diameter comprised between 100% of the minimum diameter and 100% of the maximum diameter for instance the diameter of the container is comprised between 25 mm and 45 mm; the ratio between the maximum diameter of the embossment and the minimum diameter of the outside constriction is comprised between 1.1 and 2. Each of the dimension and shape disclosed for one of the outside constriction apply for the first, second, third, etc. . . . outside constriction provided on the container. The same appears with each of the embossment (first, second, etc. . . . );

the container has a capacity comprised between 50 ml and 2 000 ml; preferably comprised between 50 ml and 1 000 ml, preferably between 50 ml and 200 ml.

the shrink-wrap has a thickness comprised between 10 μm and 150 μm (micron or micrometer), preferably of about 86 μm; preferably between 82 μm and 90 μm;

the container is at least partially filled with a beverage;

the container is further provided with a cover, the cover being connected to the container for closing the opening of the container. The cover might be a cap membrane seal, or a threaded cap when the sidewall of the container is provided with a threaded region;

The invention concerns also a method of manufacturing such a beverage bottle, comprising one following steps;

a) providing a container having an annular sidewall, a bottom and an opening opposed to said bottom, said sidewall extending along a longitudinal central axis between said bottom and said opening, said sidewall being provided with a first outside constriction and a second outside constriction and with a first embossment located between the first and second outside constrictions, b) providing a shrink wrap film depicted with an illustration having a first simulate relief, c) forming a shrink wrap onto the container in shrinking the shrink wrap film onto the sidewall of the container, whereby the first simulate relief and the first embossment are in correspondence on the beverage bottle.

There is therefore, no longer any need of orientating angularly the bottles before shrinking and the manufacture costs are reduced (simple bottles, simple equipments, and simple control).

During the method of manufacturing the container can be provided vertically (on a conveyor for instance) without any angular orientation when the shrink-wrap is formed onto the container. The shrink-wrap can be formed onto the container in being spaced along the longitudinal central axis from the opening by an opening height having a value comprised between 5% of the container height and 10% of the container height and is preferably of a minimum of 5% of the container height. Besides, the shrink-wrap can be formed onto the container in being spaced along the longitudinal central axis from the bottom by a bottom height having a value comprised between 2% of the container height and 10% of the container height, preferably of a minimum of 2% of the container height.

The shrink wrap film is stored on a source which can be a roller(s) or cut rectangles (each depicted with the illustration). When the shrink wrap film is provided on a roller, this last comprises several shrink wrap portions, one of these several shrink wrap portions being adapted to cover one container. The roller can comprise the same illustration all along the roller or can be depicted with several kinds of illustrations, the illustration being different from one adjacent shrink wrap portion to the other shrink wrap portion. Each source can be provided with one kind of illustration or with at least two different illustrations. Several kinds of illustrations allow the manufacture of beverage bottles which are provided with different illustrations whereas they are manufactured in one same manufacture lot.

When the source is provided with a sole kind of illustration, it is however possible to manufacture of beverage bottles which are provided with different illustrations, in that case, at least two sources are used, each of them provided with one kind of illustration; this means that at least two sets of cut rectangles, or at least two rollers are provided to manufacture beverage bottles with different illustrations.

With the method of manufacturing a beverage bottle according to the invention, there is no need to change molds upon changing character. The same molds can be used and only the printing on the shrink wrap film is changed. There is therefore less investments in molds and also more flexibility in supply chain of molds. The operational efficacy is besides increased since there is less stopping of the machines (no mold to be changed, no adjustment to be done for correcting the angular orientation of the beverage bottles with regard to the shrink wrap film, etc.). With the beverage bottle of the invention there is less probability of an incident during manufacture. The manufacture is thus more flexible, especially when the characters are engage. The same container can be used for different illustrations depicted on the shrink wrap. There is no need to change the container (shape of sidewall) when the illustration changes on the shrink wrap. The manufacture according to the invention leads to a late differentiation: the manufacture is common for the beverage bottle even with different characters depicted on the shrink wrap film, only at the end of the manufacture of the beverage bottles there is a difference (in the illustration represented on the shrink wrap and in the visual effect obtained from one beverage bottle to another according to the illustration represented on the shrink wrap).

This method of manufacturing can further comprise a step of filling the container with a beverage. This method of manufacturing can besides further comprise the step of covering the container with a cover.

The invention concerns also a method of designing an illustration to be depicted on a shrink wrap film covering a container of a beverage bottle of the invention, the illustration having a first simulate relief, said first simulate relief and said first embossment being in correspondence.

With such a beverage bottle, there is lower risk of stress cracking issues which could lead to in market risk of leaks; there is also a better adaptation for more efficient use of material for both EBM and ISBM, a better adaptation so transformations experienced by the bottle during the packing process (silos, unscrambling, conveying, filling, sealing, case packing etc. . . . ) leading to higher operating efficiency/process reliability. A better Speed to Market of new innovation characters) is also obtained since there is no need for the design, manufacture and qualification of new molds instead linked to the artwork process only, a better Speed to Market of new innovation (characters) as no need for the design, manufacture and qualification of change parts for the packing process and a Speed to Market of new innovation as software used to predict graphic design 'shrinkage' of a sleeve can be tuned and stay locked to the universal shape versus need to be changed for new shapes.

BRIEF DESCRIPTION OF THE DRAWINGS

Other characteristics and advantages of the invention will readily appear from the following description of one embodiment, provided as non-limitative examples, in reference to the accompanying drawings.

In the drawings.

On the different Figures, the same reference signs designate identical or similar elements.

DETAILED DESCRIPTION OF THE DISCLOSURE

Figure 2:
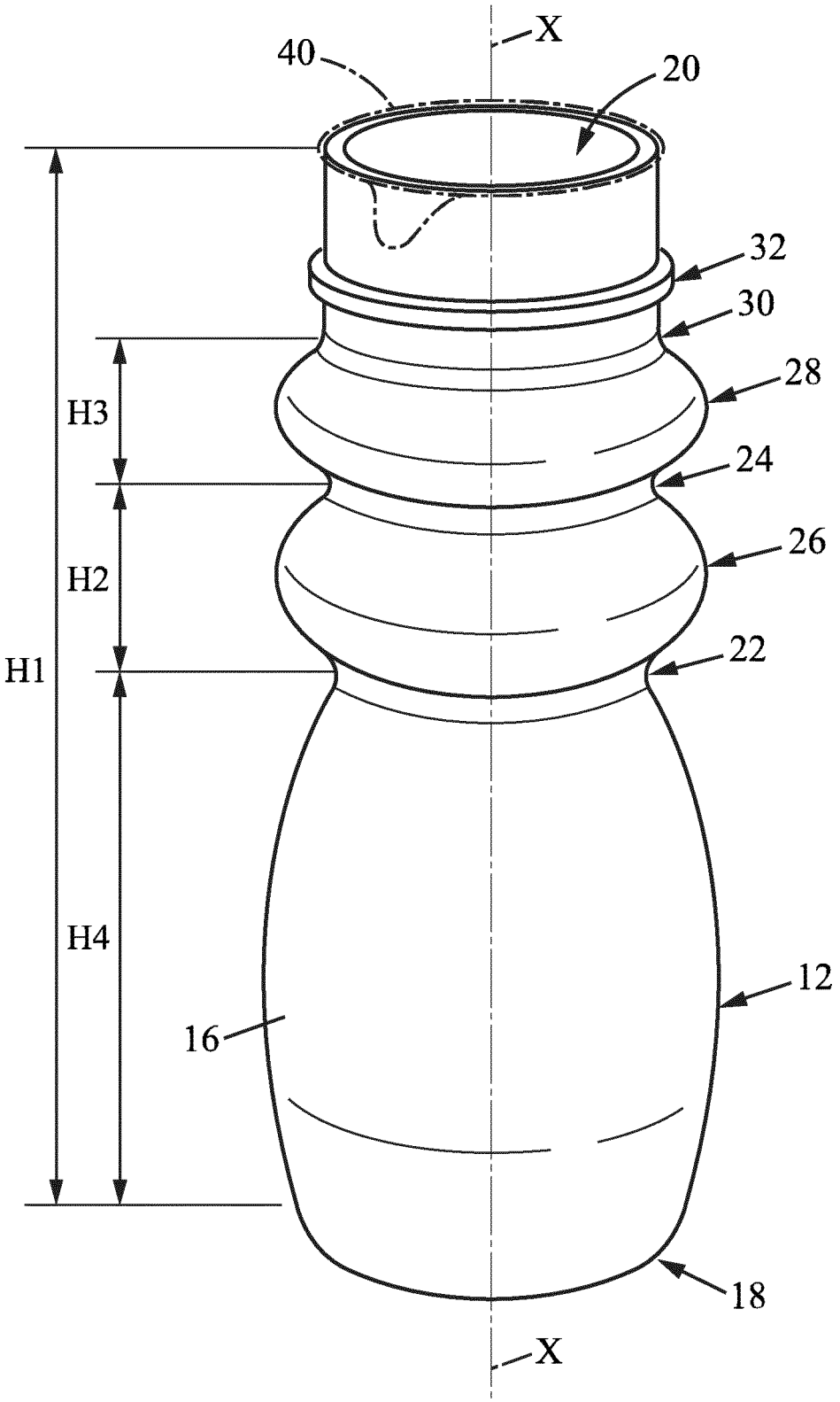
FIG. 2 is a perspective view of the beverage bottle of the invention (without the shrink wrap) closed by a cap membrane seal.

Figure shows a beverage bottle 10 comprising a container 12 and a shrink-wrap 14. More precisely and with reference to FIG. 2, the container 12 comprises an annular sidewall 16, a bottom 18 and an opening 20 opposed to said bottom 18. The sidewall 16 extends along a longitudinal central axis X-X between the bottom 18 and the opening 20.

The detailed following description is given with an example of dimensions (for the container, the sidewall, embossments, outside restrictions, etc. . . . ); these dimensions should not be considered as any kind of limitation, but only as one possible embodiment. The container height H1 of the container along the longitudinal central axis X-X can for instance be comprised between 70 mm and 125 mm along the longitudinal central axis, for instance equal to 100 mm.

The sidewall 16 is provided with a first outside constriction 22 and a second outside constriction 24 and with a first embossment 26 located between the first 22 and second 24 outside constrictions.

Figure 1:
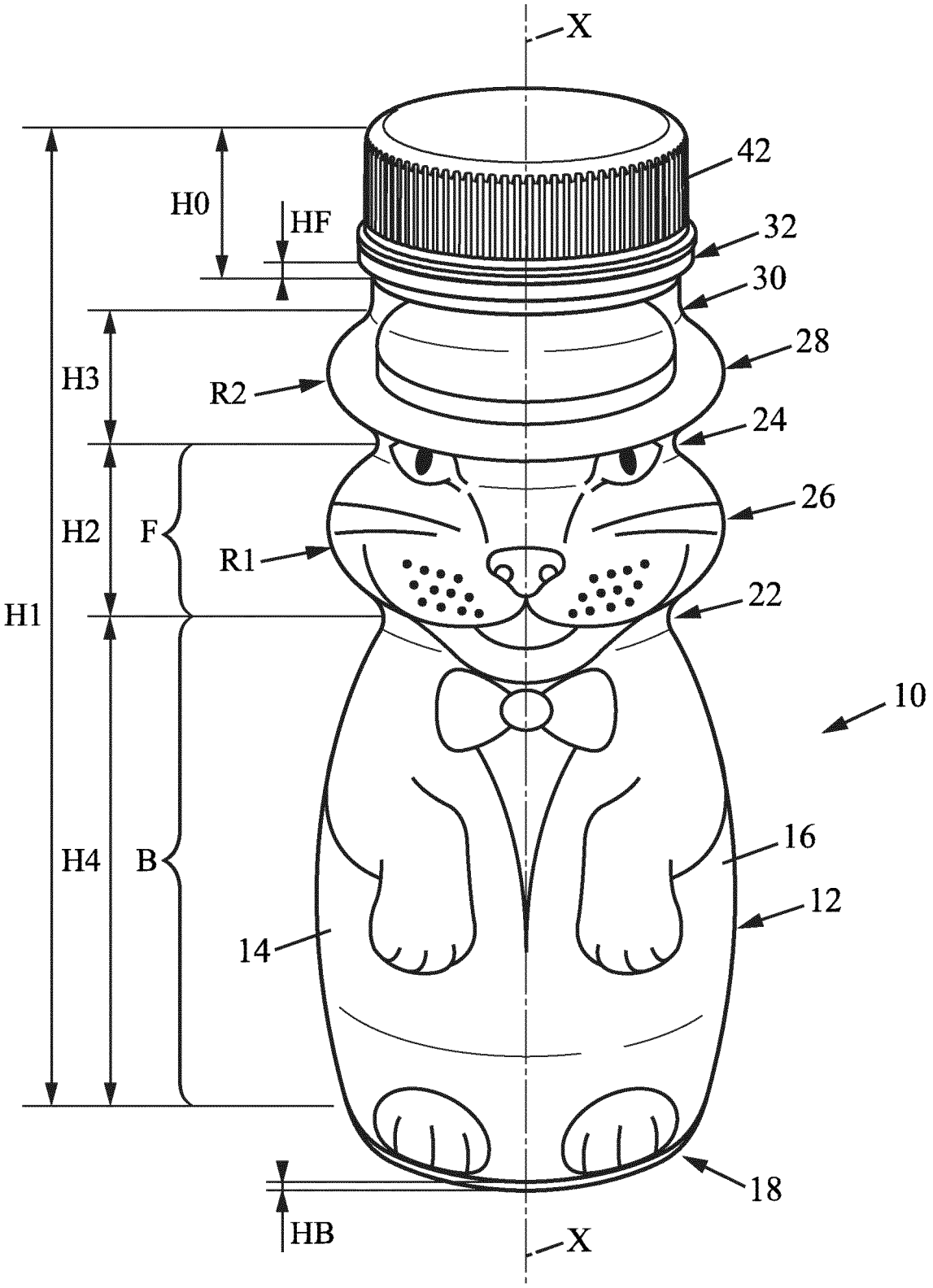
FIG. 1 is a perspective view of the beverage bottle of the invention (with the shrink wrap) closed by a threaded cap.

According to the invention, the sidewall is covered with the shrink-wrap 14 as best depicted on FIG. 1, said shrink-wrap 14 being depicted with an illustration A. The illustration A has a first simulate relief R1 which is in correspondence with the first embossment 26. For instance, as depicted on FIG. 1, the illustration A represents an animal having its face F substantially depicted above the first outside constriction 22, while the body B is depicted below the first outside constriction 22. Of course, one should understand that the invention is not limited to such kind of illustration which is only given as an example in order to better understand the invention. Any other kind of illustrations can be provided on the shrink wrap.

The first simulate relief R1 comprises for instance the head of the character (here an animal) having a nose and two cheeks provided on face F. The nose and the two cheeks are preferably provided on the first embossment 26 especially to improve the visual effect of the 3D of these parts of the illustration A. The rear part of the beverage bottle (not illustrated) can be provided with hair. The face F can be further provided with eyes which are depicted on the second outside constriction 24 especially to improve the visual effect of the 3D of this part of the illustration A. This part of the illustration is thus preferably in correspondence with the second outside constriction 24.

According to the illustration, a second embossment 28 can be provided on the container 12. In that case, the second embossment 28 is preferably located between the second outside constriction 24 and a third outside constriction 30 which is provided on the container 12. The first outside constriction 22, the second outside constriction 24 and the third outside constriction 30 are preferably respectively superimposed along the longitudinal central axis X-X and are spaced apart from each other by a height comprised between 5% and 50% of the container height, for instance being of at least 2 mm along the longitudinal central axis X-X. More precisely, along the longitudinal central axis X-X, the first outside constriction 22 and the second outside constriction 24 are spaced apart by a height H2 comprised between 2 mm and 40 mm, preferably of about 20 mm, whereas the second outside constriction 24 and the third outside constriction 30 are spaced apart by a height H3 which can also be comprised between 2 mm and 40 mm, preferably of about 20 mm. Besides, the first outside constriction 22 can be located at a height of about 50% of the container height from the bottom of the container; thus the first outside constriction 22 and the bottom 18 are spaced apart by a height H4 comprised between 2 mm and 40 mm, preferably of about 50 mm especially when the illustration comprises a simulate relief in the top of the shrink wrap 14.

The shrink-wrap 14 preferably surrounds all the way round the sidewall 16 in extending between the opening 20 and the bottom 18. However, especially to improve the aesthetic result and make the manufacture of the beverage bottle 10 easier and simpler, the shrink-wrap 14 can be spaced along the longitudinal central axis X-X from the opening 20 by an opening height HO having a value comprised between 2% of the container height H1 and 15% of the container height H1, for instance of a minimum of 9 mm, preferably of about 12 mm. Analogously, the shrink-wrap 14 can be spaced along the longitudinal central axis X-X from the bottom 18 by a bottom height HB having a value between 2% of the container height H1 and 10% of the container height H1, for instance of a minimum of 2 mm, preferably of 2.5 mm.

The container 12 can be further provided with a flange 32 located between the opening 20 and the first outside constriction 22, preferably between the opening 20 and the second outside constriction 24 and when the container is provided with a third outside constriction, preferably between the opening 20 and the third outside constriction 30. The shrink-wrap 14 surrounds all the way round the sidewall in extending between the flange 32 and the bottom 18, the shrink-wrap 14 being spaced along the longitudinal central axis X-X from the flange 32 by a flange height HF having a value between 2% of the container height and 5% of the container height or 15% of the container height of a minimum of 3 mm (measured under the flange 32 toward the bottom 18), preferably of about 5 mm, and from the bottom 18 by the bottom height HB. The shrink-wrap 14 thus forms a full sleeve provided onto the sidewall of the container 12 substantially between the flange 32 and the bottom 18.

Referring back on FIG. 1, the illustration A of the shrink-wrap 14 can be depicted with a second simulate relief R2, said second simulate relief R2 and said second embossment 28 being in correspondence especially to improve the 3D visual effect of the second simulate relief R2.

The second simulate relief R2 comprises for instance a hat provided on the head of the character. The fact that the hat is provided on the second embossment 28 especially improves the visual effect of the 3D of this part of the illustration A.

Figure 3:
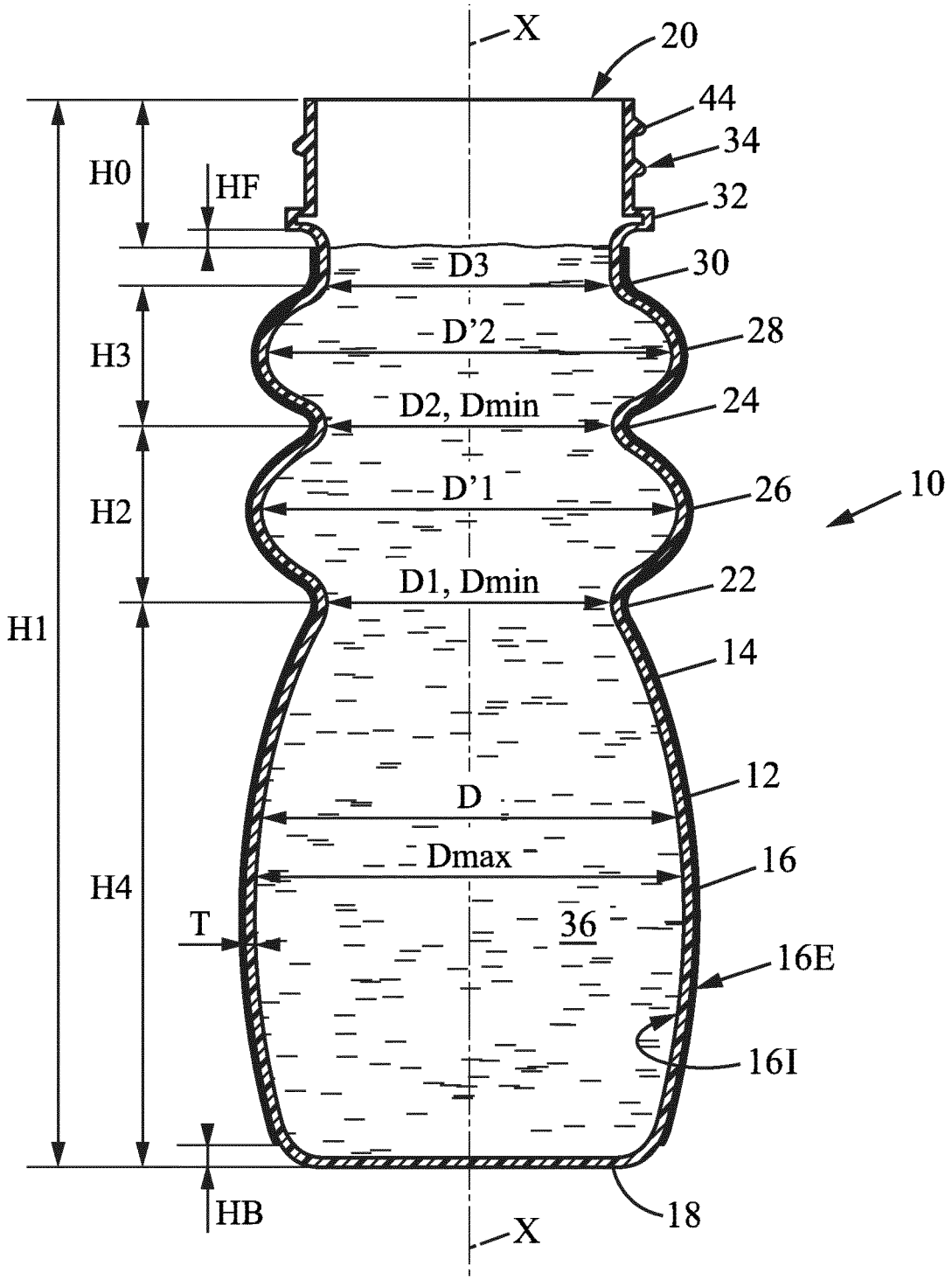
FIG. 3 is a sectional view of the beverage bottle of FIG. 1 (without the threaded cap).

As best seen on FIG. 3, the sidewall 16 is preferably annular all along the longitudinal central axis X-X between the bottom 18 and the opening 20. Actually, the longitudinal central axis is in that case a central axis X-X. The sidewall 16 is axisymmetric and has an internal diameter D comprised between 25% and 50% of the container height H1; the sidewall 16 having a diameter D which varies along the longitudinal central axis X-X; the variation is for instance between 25 mm and 45 mm. This means that any transversal section (perpendicular to the central axis X-X) is circular, even for the first, second and third outside constrictions 22, 24 and 30 and for the first and second embossments 26 and 28. The thickness T of sidewall 16 is preferably sensibly the same along the circular axis X-X. The thickness T is preferably comprised between 0.5% and 2% of the container height H1, for instance comprised between 0.5 mm and 1.5 mm. Besides, the shape of the internal surface 16I of the sidewall 16 is preferably the same as the external surface 16E of the sidewall 16.

The first, second and third outside constrictions 22, 24 and 30, are each preferably concave view from the external of the bottle; from the internal of the bottle they are convex; and each forms an annular groove 22, 24 and 30 all the way round the sidewall 16. The internal diameter D of the sidewall is consequently reduced in these parts of the container 12 with regard to the general dimension of the last. More precisely, the internal diameter D is preferably comprised between 25 mm and 45 mm under the first outside constriction 22, whereas the internal diameter D is preferably of the first, second and third outside constrictions 22, 24 and 28 is preferably less than 35 mm. The internal diameter D of the part of the sidewall 16 located under the first external constriction 22 can be convex view from the external of the bottle; the first external constriction 22 can be concave view from the internal of the bottle and has preferably a substantially continuing variation of the internal diameter between the first outside constriction 22 and the bottom 18. More precisely, when measuring one container 12, the part of the sidewall 16 located under the first external constriction 22 has an internal diameter D which varies along the longitudinal central axis X-X between a minimum diameter Dmin which is of about 25 mm, and a maximum diameter Dmax which is of about 45 mm. The internal diameter D of the bottom can be comprised between 20% and 50% of the container height H1 and is for instance of about 28 mm.

The internal diameter D1 of the first outside constriction 22 is preferably comprised between 25 mm and 35 mm, preferably of about 28 mm. The internal diameter D2 of the second outside constriction 24 is preferably comprised between 25 mm and 35 mm, preferably of about 28 mm. The internal diameter D3 of the third outside constriction 30 is preferably comprised between 25 mm and 35 mm, preferably of about 28 mm. Actually, the internal diameters D1, D2 and D3 can be equal. Besides, the internal diameters D1, D2 and/or D3 can be of the same value of the minimum diameter Dmin. The measurement of the value of each of these internal diameters D1-D3 is made where the diameter is the smallest one in the considered zone of the sidewall 16. The heights indicated above (H2, H3 and H4) are preferably measured where the internal diameter is the smallest one.

The first and second embossments 26 and 28 are each preferably convex view from the external of the bottle; the first and second embossments 26 and 28 are each preferably concave view from the internal of the bottle and each forms an annular coil 26 and 28 all the way round the sidewall 16. The first and second embossments 26 and 28 have preferably a substantially continuing variation of the internal diameter D. More precisely, the internal diameter D of the first or second embossment is preferably varying between 25 mm and 45 mm. The maximum value for the internal diameter D'1 of the first and second embossments 26 can be of about 45 mm. Actually, the internal diameter D of the first embossment 26 is varying between the first and second constrictions 22 and 24, the maximum D'1 being located for instance more or less at half distance between the first and second constrictions 22 and 24, whereas the minimums are located on respective first and second constrictions 22 and 24. Analogously, the internal diameter D of the second embossment 28 is varying between the second and the third constrictions 24 and 30, the maximum. D'2 being located for instance more or less at half distance between the second and the third constrictions 24 and 30, whereas the minimums are located on respective second and third constrictions 24 and 30. The maximum D'1 and/or maximum D'2 can be substantially equal to the maximum internal diameter Dmax.

The flange 32 of the container 12 has preferably internal diameter D which is comprised preferably between 20% and 50% of the container height H1, for instance between 28 mm and 45 mm, preferably of about 32 mm. The container comprises a neck 34 extending between the flange 32 toward the opening 20. The internal diameter D of the neck corresponds preferably to the one of the opening 20 and is preferably comprised between 25 mm and 35 mm, preferably of about 28 mm. The neck 34 is preferably cylindrical with a constant internal diameter.

With the above given dimensions, the container 12 has a capacity comprised preferably between 100 ml and 200 ml.

Such a beverage bottle 10 above described can be filled at least partially with a beverage 36. The container 12 is especially to this extend preferably made of polypropylene or polyethylene, for example high density polyethylene (HDPE). The material of the container 12 can further comprise pigments (such as $TiO_2$). The beverage bottle 10 can comprise any beverage, such as carbonated or non-carbonated water, carbonated or non carbonated sodas, fruit juice, milk, dairy product such as drinking yogurt, medical food, baby food. The material of the shrink wrap 14 comprises preferably a plastic or plastic like material, for example bi-axially orientated films of PVC (Polyvinyl chloride), PET (Polyethylene terephthalate), EVA (Ethylene-Vinyl Acetate), PP (Polypropylene), PE (Polyethylene), EP (Ethylene Propylene), or layered constructions therewith. Besides, the shrink-wrap 14 has a thickness preferably comprised between 10 μm (micron or micrometer) and 150 μm, preferably of about 80 μm to 100 μm, preferably of 86 μm. The shrink wrap 14 can improve the harrier to oxygen particularly important for dairy products, especially when the shrink wrap 14 cover substantially ail the sidewall 16 as a full sleeve as above mentioned. Actually the shrink wrap 14 is preferably covering the sidewall 16 more or less from its bottom 18 up to the maximum level of the beverage filling (when the container 12 is vertical).

The beverage bottle 10 comprises preferably a cover which can be connected to the container 12 for closing the opening 20 of the container 12. The cover can be cap membrane seal 40 covering the opening 20 as illustrated in dash-points on FIG. 2 or can be cover is a threaded cap 42 as illustrated on FIG. 1. In that last case, the sidewall 16 of the container 12, more precisely its neck 34 is provided with a threaded region 44 (as best visible on FIG. 3) which cooperate with the internal thread of the threaded cap 42.

A method of manufacturing a beverage bottle 10 will now be described in reference to FIGS. 4A and 5A. According to invention the method of manufacturing, comprises the following steps. A container 12 as above disclosed is provided. More precisely, a conveyor 46 can bring the container 12 in a shrink wrap station 48. There is no need to put the container 12 in any specific angular orientation. Accordingly the method preferably does not involve any orientation step, and/or does not involve orientation means allowing detecting the angular orientation and means to change the angular orientation. The container 12 is just provided on the conveyor, for instance vertically if the shrink wrap film arrives also vertically.

A shrink wrap film 50 depicted with illustrations is besides provided and brought in the shrink wrap station 48. The shrink wrap film 50 is preferably wind up onto a source 52, for instance as depicted on the figures, on a roller 52. The shrink wrap film 50 comprises preferably a plastic or plastic like material as above mentioned which is beforehand depicting by printing or other well known manners) with a series of illustrations. More precisely, the shrink wrap film 50 comprises several shrink wrap portions 54, one of these several shrink wrap portions 54 being adapted to cover one container 12. The shrink wrap film 50 is provided such that the shrink-wrap 14 is formed onto the container 12 in being spaced along the longitudinal central axis X-X from the opening 20 by an opening height HO having a value of a minimum of 5% of the container height H1 and from the bottom 18 by a bottom height HB having a value of a minimum of 2% of the container height H1. The shrink wrap film is of course is a good alignment with regard to the container. More specifically, it is such that the shrink wrap will be provided correctly with regard to the longitudinal central axis X-X. Apart these specific height positioning, there is no need of particular angular orientation of the container, especially there is no need of particular angular orientation of the container with regard to the shrink wrap film about the longitudinal central axis X-X.

The process can involve forming a tube around the bottle from the source of film, optionally with some cutting steps (preferably by disposing a tube vertically on a standing bottle)—positioning the tube vertically such that the relief correspondence is ensured. The tube preferably stands of the conveyor, the dimension of the shrink wrap and the position of the illustrated matter is such that the correspondence is ensured.

shrinking by applying heat, for example in an oven or tunnel, for example with hot air or steam. The shrinkage will be high on the constrictions zone. The radial shrinkage can be for example for from 50% to 98%.

The illustration provided on the shrink wrap film 50 is as known a little bit different from the one obtained after shrinking (especially the dimension and visual appearance).

Figure 4A:
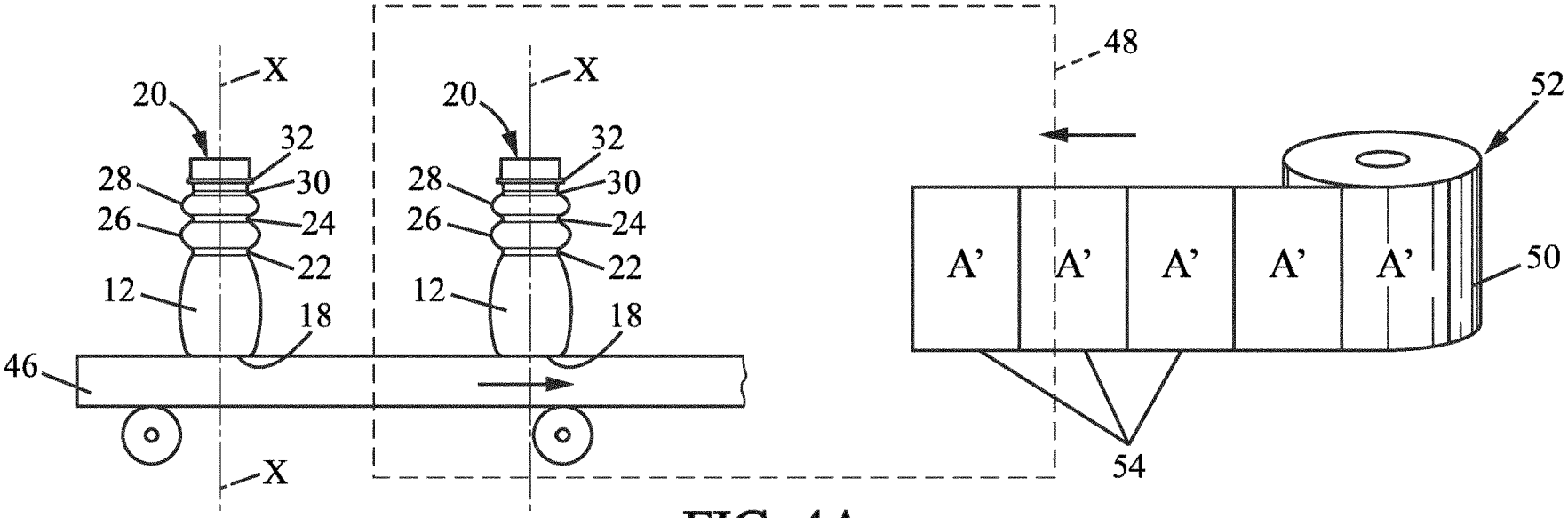
FIG. 4A is a side view of the manufacture of the beverage bottle according to the invention.
Figure 5A:
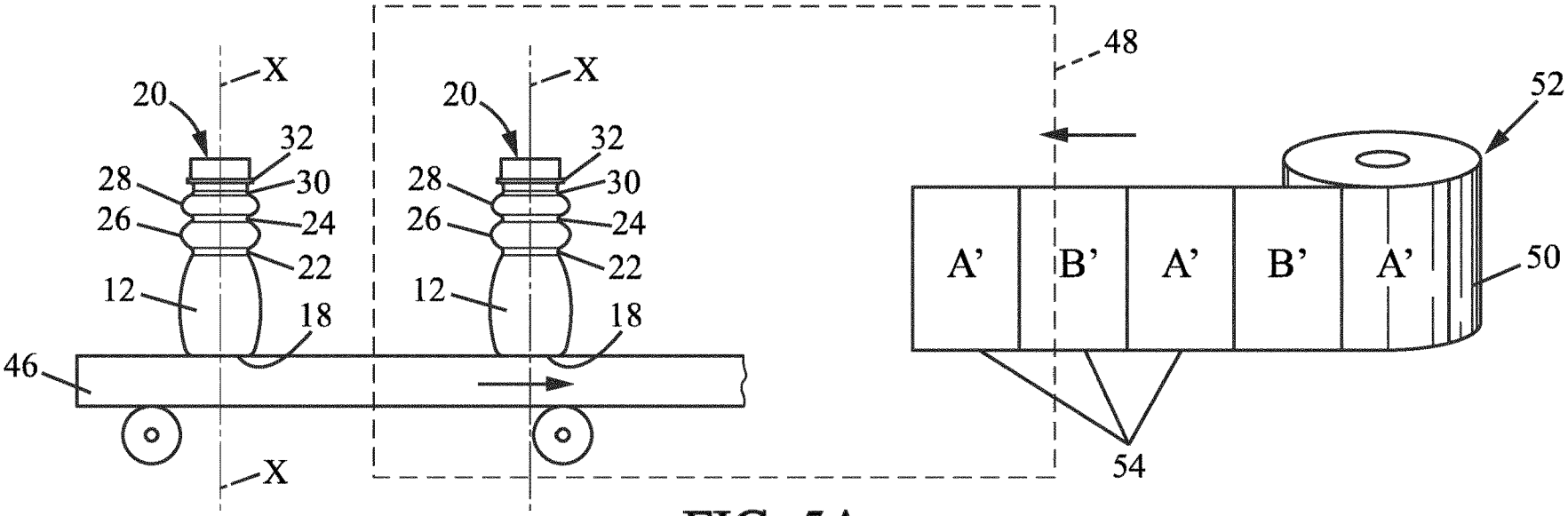
FIG. 5A is a side view of the manufacture of the beverage bottle according to another embodiment.

FIG. 4A shows roller 52 having a shrink wrap film 50 which comprises a series of the same illustrations for instance illustrations A, whereas FIG. 5A shows a roller 52 having a shrink wrap film 50 which comprises two series of the same illustrations for instance illustrations A and B. Actually, the shrink wrap 14 depicted on FIG. 4A comprises shrink wrap portions 54 provided with the same illustration A, whereas the shrink wrap film 50 depicted on FIG. 5A comprises shrink wrap portions 54 provided with two different illustrations A and B, the illustration A being different from the illustration B which is adjacent to the illustration A. This means that a shrink wrap portion depicted with illustration A and a shrink wrap portion depicted with illustration 13 are alternatively disposed on the shrink wrap film 50. Of course, one should understand that the shrink wrap film 50 can be provided with more than two different series of illustrations.

The illustrations can be alternatively provided on the shrink wrap film 50 as depicted on FIG. 5A, it can be provided in two groups (not illustrated): this means that among a define length of the shrink wrap film 50 a first series of same illustrations A is provided, whereas further on the roller 52, a define length of the shrink wrap film 50 is provided with a second series of same illustrations B. In each case, the shrink wrap film 50 is depicted with an illustration having a first simulate relief R1 (not illustrated on FIG. 4A-4B or 5A-5B).

The shrink wrap film 50 is applied to the container 12 by known shrink-wrap techniques and a shrink wrap 14 is thus formed onto the container 12 in shrinking one of shrink wrap portions 54 onto the sidewall of one container 12, whereby the first simulate relief R1 and the first embossment 26 are in correspondence on the beverage bottle 10.

According to the roller 52 chosen (provided with the same illustration A or series of two or more illustrations A and B or more), the beverage bottles 10 obtained are the same or are different with regard to the illustration depicted on the shrink wrap 14. One should also understand that when the illustration depicted on the beverage bottle 10 has to change, the method of manufacturing a beverage bottle 10 can comprise a step in which the roller 52 is changed. More precisely after the manufacture of a first series of beverage bottles provided with illustrations A, the roller provided with illustrations A can be replaced by a roller provided with illustrations B and the beverage bottles manufactured are depicted with illustrations B.

In any cases, the container shape is the same even when the illustrations are different. This leads to a reduction of the costs of manufacturing the beverage bottle 10, but also of the costs of manufacturing the container 12.

Besides, the shrink wrap film 50 can be provided with small holes allowing the air confined between the container 12 and the shrink wrap 14 to get trough during the step of shrinking the shrink wrap portion 54 onto the container 12. These holes (not depicted on the figures) can be located. In the outside constriction (first 22, second 24 and/or third 30).

Figure 4B:
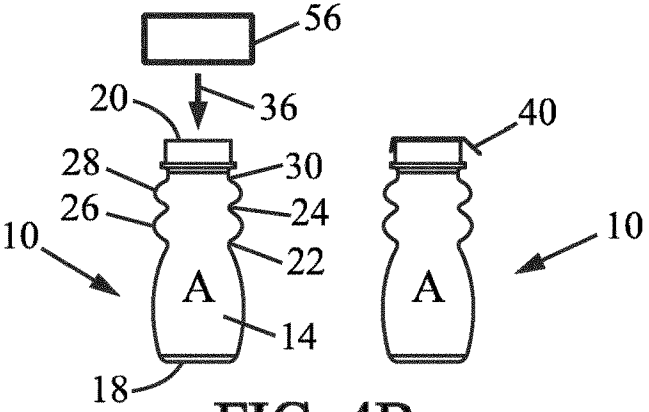
FIG. 4B is a side view of the manufacture of the beverage bottle according to FIG. 4A with a further step.
Figure 5B:
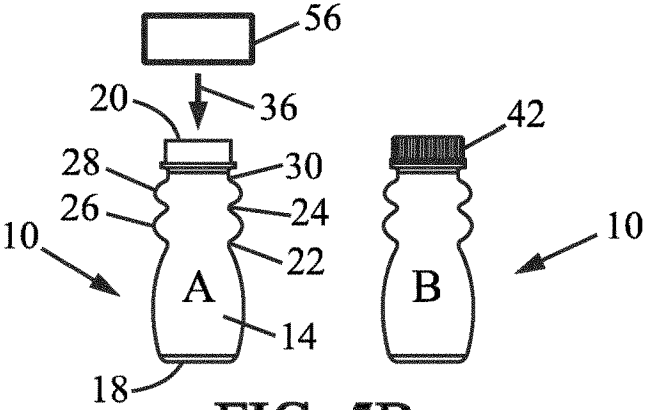
FIG. 5B is a side view of the manufacture of the beverage bottle according to FIG. 5A with a further step.

According to the invention, when the container 12 is covered with the shrink wrap 14, thus forming a beverage bottle 10 it can be filled with a beverage as depicted on FIGS. 4B and 5B with help of a known filling station 56.

The method of manufacturing a beverage bottle 10 can further comprise a step of covering the container 12 with a cover. After the beverage 36 is poured in the beverage bottle 10, the opening 20 of the beverage bottle 10 can be closed by a cap. FIG. 4B shows a beverage bottle 10 onto which a cap membrane seal 40 has being provided, whereas FIG. 5B shows a beverage bottle 10 onto which a threaded cap 42 has being provided.

A method of designing an illustration to be depicted on a shrink wrap film 50 covering a container 12 of a beverage bottle 10 as above described comprises the step of design an illustration A' (or respectively B') which after the shrink wrap film 50 will have been shrunk onto the container 12 will correspond to illustration A (or respectively B) and have having a first simulate relief simulate relief R1 in correspondence with the first embossment 26 of the container 12. The method of designing an illustration can also comprises a step of designing said illustration which after the shrink wrap film 50 will have been shrunk onto the container 12 will have having a second simulate relief simulate relief R2 in correspondence with the second embossment 28 of the container 12. These steps can be repeated according to the number of embossments provided on the container 12.

The invention claimed is:

1. A beverage bottle comprising:

a container having an annular sidewall, a bottom, and an opening opposed to said bottom; and a shrink-wrap, the opening being provided at a top of a neck, said sidewall extending along a longitudinal central axis between said bottom and said opening, said sidewall being provided with a first outside constriction and a second outside constriction, the sidewall comprising a first longitudinal part longitudinally extending under the first outside constriction, the first longitudinal part having a convex shape as viewed from the exterior of the beverage bottle, and a second longitudinal part longitudinally extending between the first outside constriction and the second outside constriction, the second longitudinal part being provided with a first embossment located between the first and second outside constrictions, the first outside constriction having a concave shape as viewed from the exterior of the beverage bottle and a continuously varying curvature, the first embossment having a convex shape as viewed from the exterior of the beverage bottle, the first and second longitudinal parts of the sidewall forming a wavy longitudinal profile, the sidewall being covered with the shrink-wrap, said shrink-wrap being depicted with an illustration having a first simulate relief, said first simulate relief being positioned in correspondence with the first embossment, wherein the shrink-wrap surrounds all the way around the sidewall in extending between the opening and the bottom, the shrink-wrap being spaced along the longitudinal central axis from the opening by an opening height having a value comprised between 1% and 20% of the container height, and spaced from the bottom by a bottom height having a value comprised between 0.5% and 20% of the container height.

2. The beverage bottle according to the claim 1, wherein the illustration is a character provided with a head which is at least partially in correspondence with the first embossment.

3. The beverage bottle according to claim 1, wherein the illustration is provided with a relief of illustrated matter.

4. The beverage bottle according to claim 1, wherein the illustration is a character provided with a head which is at least partially in correspondence with the first embossment, wherein the illustration is provided with a relief of illustrated matter and wherein the head is provided with a nose, a mouth and/or ears positioned at a height of the first embossment.

5. The beverage bottle according to claim 1, wherein the sidewall is provided with a third outside constriction and a third longitudinal part extending between the second and third outside constrictions, the third longitudinal part being provided with a second embossment located between the second and third outside constrictions, the illustration of the shrink-wrap being depicted with a second simulate relief, said second simulate relief being in correspondence with the second embossment.

6. The beverage bottle according to claim 1, wherein the first and second outside constrictions are superimposed along the longitudinal central axis and are spaced apart from each other by a height which is comprised between 5% and 50% of the container height along the longitudinal central axis.

7. The beverage bottle according to claim 1, wherein each of the first and second outside constrictions each forms an annular groove all the way around the sidewall.

8. The beverage bottle according to claim 1, wherein the neck is further provided with a flange, and wherein the shrink-wrap surrounds all the way around the sidewall in extending between the flange and the bottom, the shrink-wrap being spaced along the longitudinal central axis from the flange by a flange height having a value comprised between 0.5% and 10% of the container height.

9. The beverage bottle according to claim 1, wherein the sidewall has an internal maximum diameter comprised between 10% and 75% of the container height, the sidewall having a diameter which varies along the longitudinal central axis and having a minimum diameter which is comprised between 50% and 95% of the container maximum diameter, wherein the first and the second outside constrictions each has an internal diameter comprised between 100% of the minimum diameter and 95% of the maximum diameter, and wherein first embossment has an internal diameter comprised between 100% of the minimum diameter and 100% of the maximum diameter.

10. The beverage bottle according to claim 1, wherein the container has a capacity comprised between 50 ml and 2 000 ml.

11. The beverage bottle according to claim 1, wherein the shrink-wrap has a thickness comprised between 10 μm and 150 μm.

12. The beverage bottle according to claim 1, wherein the container is at least partially filled with a beverage.

13. The beverage bottle according to claim 1, further comprising a cover, wherein the cover is connected to the container for closing the opening of the container.

14. The beverage bottle according to claim 13, wherein the cover is a cap membrane seal.

15. The beverage bottle according to claim 13, wherein the cover is a threaded cap and the sidewall of the container is provided with a threaded region.

16. A method of manufacturing a beverage bottle according to claim 1, the method comprising:

providing a container having an annular sidewall, a bottom, and an opening opposed to said bottom, the opening being provided at a top of a neck, said sidewall extending along a longitudinal central axis between said bottom and said opening, said sidewall being provided with a first outside constriction and a second outside constriction, the sidewall comprising a first longitudinal part longitudinally extending under the first outside constriction, the first longitudinal part having a convex shape as viewed from the exterior of the beverage bottle, and a second longitudinal part longitudinally extending between the first outside constriction and the second outside constriction, the second longitudinal part being provided with a first embossment located between the first and second outside constrictions, the first outside constriction having a concave shape as viewed from the exterior of the beverage bottle and a continuously varying curvature, the first embossment having a convex shape as viewed from the exterior of the beverage bottle, the first and second longitudinal parts of the sidewall forming a wavy longitudinal profile;

providing a shrink-wrap film depicted with an illustration having a first simulate relief; and forming the shrink-wrap onto the container in shrinking the shrink-wrap film onto the sidewall of the container, whereby the first simulate relief and the first embossment are in correspondence on the beverage bottle.

17. The method of manufacturing a beverage bottle according to claim 16, wherein the container is provided vertically without any angular orientation, and wherein the shrink-wrap is formed onto the container.

18. The method of manufacturing a beverage bottle according to claim 16, wherein the opening height has a value of a minimum of 5% of the container height and the bottom height has a value of a minimum of 2% of the container height.

19. The method of manufacturing a beverage bottle according to claim 16, wherein the shrink-wrap film is provided on a source which comprises a plurality of shrink-wrap portions, one of the plurality of shrink-wrap portions being configured to cover one container.

20. The method of manufacturing a beverage bottle according to claim 19, wherein the source comprises a plurality of kinds of illustrations, the illustrations being different from one adjacent shrink-wrap portion to another shrink-wrap portion.

21. The method of manufacturing a beverage bottle according to claim 16, further comprising filling the container with a beverage.

22. The method of manufacturing a beverage bottle according to claim 16, further comprising covering the container with a cover.

23. A method of designing an illustration to be depicted on a shrink-wrap film covering a container of the beverage bottle according to claim 1, the illustration having a first simulate relief, said first simulate relief and said first embossment being in correspondence.

24. The beverage bottle according to claim 1, wherein the opening height has a value comprised between 1% to 10% of the container height.

25. The beverage bottle according to claim 1, wherein the bottom height has a value comprised between 1% and 10% of the container height.

26. The beverage bottle according to claim 5, wherein the first, second and third outside constrictions are superimposed along the longitudinal central axis and are spaced apart from each other by a height which is comprised between 5% and 50% of the container height along the longitudinal central axis.

27. The beverage bottle according to claim 1, wherein the sidewall has a continuously varying internal diameter between the bottom and the first constriction.

28. The beverage bottle according to claim 1, wherein the second outside constriction has a concave shape as viewed from the exterior of the beverage bottle and a continuously varying curvature.

* * * * *